US005086535A

United States Patent [19]

Grossmeyer et al.

[11] Patent Number: 5,086,535

[45] Date of Patent: Feb. 11, 1992

[54] MACHINE AND METHOD USING GRAPHIC DATA FOR TREATING A SURFACE

[75] Inventors: Mark Grossmeyer, Cedarburg; Geoffrey B. Rench, Racine, both of Wis.

[73] Assignee: Racine Industries, Inc., Racine, Wis.

[21] Appl. No.: 600,848

[22] Filed: Oct. 22, 1990

[51] Int. Cl.[5] ..... A47L 9/28

[52] U.S. Cl. ..... 15/319; 15/339; 15/340.1; 180/167; 180/169; 901/1

[58] Field of Search ..... 15/319, 339, 340.1, 15/340.2; 901/1; 180/167, 169, 168

[56] References Cited

U.S. PATENT DOCUMENTS

| | | | |
|---|---|---|---|
| 3,789,939 | 9/1971 | Geislinger | 180/6.5 |
| 4,114,711 | 9/1977 | Wilkins | 180/6.5 |
| 4,700,427 | 10/1986 | Knepper | 15/319 |
| 4,996,468 | 2/1991 | Field et al. | 180/169 X |
| 5,012,886 | 5/1991 | Jonas et al. | 15/340.1 X |

FOREIGN PATENT DOCUMENTS

| | | | |
|---|---|---|---|
| 2251271 | 10/1972 | Fed. Rep. of Germany | 15/319 |
| 227056 | 9/1985 | Fed. Rep. of Germany | 15/319 |
| 3536974 | 4/1987 | Fed. Rep. of Germany | 15/319 |

OTHER PUBLICATIONS

Host Camp Carpet Maintenance Paln-1984.

*Primary Examiner*—Chris K. Moore

*Attorney, Agent, or Firm*—Jansson & Shupe, Ltd.

[57] ABSTRACT

A machine for treating a surface area within a boundary perimeter includes a self propelled chassis having a surface treating device mounted on it. A computing section is mounted on the chassis and a powered wheel (or each of plural powered wheels) has a motor module for receiving command signals from the computing section. A position sensor is coupled to the computing section for generating a feedback signal representing the actual position of the machine. A data loading device coacts with the computing section for transmitting data to such computing section. A data file stores graphic data developed from a graphic depiction representing the surface area to be treated as well as other data developed in other ways. The data file coacts with the computing section and transmits graphic and other data to it. The computing section is arranged for processing the data and the feedback signal and responsively generating command signals directed to each motor module. Such modules, and the motors controlled thereby, propel the machine over the surface area selected to be treated. A method for treating a surface area is also disclosed.

24 Claims, 3 Drawing Sheets

MACHINE AND METHOD USING GRAPHIC DATA FOR TREATING A SURFACE

FIELD OF THE INVENTION

This invention is related generally to surface treating machines and more particularly to such machines which use graphic data developed from a blueprint or the like to treat selected surface areas within a boundary perimeter.

BACKGROUND OF THE INVENTION

Certain types of areas lend themselves to surface treatment by machine and in fact, are often treated with such machines. Examples include grassy areas such as golf courses which are treated by self propelled powers, fertilizer-spreading equipment and the like. Parking lots and other types of road surface areas are treated by being swept periodically using self-propelled machines having dirt collecting equipment mounted thereon. Still other examples of surfaces which lend themselves to treatment by machine include hard-surface floors which may be mechanically scrubbed or waxed and carpeted areas which may be vacuumed or otherwise cleaned.

Such surface treating situations often share a common characteristic. That is, the treating operation is frequently highly repetitive and involves the exercise of relatively little judgment or effort on the part of the machine operator. As an example, a particular parking lot or roadway usually is (or at least can be) uniformly swept using the same pattern time after time. About the only thing the machine operator need decide is when and in which direction to turn the machine.

However, carpeted areas in industrial and commercial establishments present a somewhat different problem in that it may not be necessary or cost effective to uniformly treat the entire carpeted area by vacuuming using the same pattern time after time and every time. That is, carpets will tend to become more heavily soiled in certain predictable areas and at a predictable rate.

Areas which become soiled at a more rapid rate include those adjacent doorways leading to and from the exterior and main traffic areas such as often-used aisles. Other areas, along walls for instance, will become only lightly soiled, even over extended periods of time. Therefore, a highly desirable surface treating strategy, the carpet vacuuming plan, will recognize such varying soiling rates and require vacuuming with frequencies keyed to such rates. The CAMP ® carpet maintenance plan offered by Racine Industries, Inc. of Racine, Wisconsin, is such a plan.

The fact that such carpeted areas vary in soiling rates presents an opportunity for significant cost savings when vacuuming such carpeted areas. More specifically, surface treatment operations tend to be labor intensive and the cost saving opportunity lies in an ability to vacuum selected areas at selected frequencies For example, of the total cost of vacuuming large areas of carpet in a commercial setting—an office building or hospital, for example—the labor component of such total cost may be in the range of 70%.

Previous workers in this field have expressly or implicitly recognized the high labor content of such surface treating operations and have developed machines to reduce the cost of such labor. For example, U.S. Pat. No. 4,114,711 describes a floor treating machine which may be programmed to repeat a pattern of movement automatically. Programming is by first operating the machine manually and recording on a tape recorder certain signals arising from such manual operation. This "teaches" the machine the repetitive pattern to be followed. The tape is then replayed when automatic operation is desired. A distance check device provides a feedback signal of the actual distance travelled by the machine. This signal is compared with the distance programmed to have been travelled and causes the correction of slight errors.

The apparatus shown in U.S. Pat. No. 3,789,939 uses a similar approach in that a wheeled cart such as a lawnmower may be programmably controlled to follow a particular route. The route or path is initially established by operating the cart manually over the desired path to be travelled and tape recording the resulting feedback signals The cart is then expected to follow the same path in accordance with the recorded signals.

Still another approach is shown in U.S. Pat. No. 4,700,427. The machine shown therein involves automatic steering of a self propelled floor cleaning machine. One way to program the machine is to manually operate it over the area and path to be treated. Signals are simultaneously "memorized" and permit the machine to automatically follow the path thereafter. In the alternative, data is generated by automatically travelling the area to be worked, such travel being under the control of a program which stores the travelled path segments as travel occurs. Mathematical algorithms are then used to "shape" the data to minimize the total path length and/or the total working time In operation, correct execution of the command signals is monitored by transducers and telemetry equipment. Such telemetry equipment permits the detection of obstacles to activate a bypass program, causing the machine to detour around the obstacle.

Even though the machine shown in the foregoing patent is said to be operable automatically from the onset, it is clear from the specification that this initial "automatic" operation must be attended by a degree of later data modification if optimum performance is to result. In any event, the machine must be made to follow the desired path, even though "automatically," in order to permit the machine to optimally operate on the second and successive passes over the area.

These prior machines are probably effective to a degree. However, they require that the machine be first operated manually over the area to be treated or require later data modification to permit the machine to fully "memorize" and follow the desired path. If the surface area to be treated is large, as with the carpeted areas of a multi-story office building, the time required to prepare such machines for fully automatic operation is truly significant. This fact tends to detract from the cost saving advantages which may otherwise accrue from using such machines.

A machine and method for treating a selected surface area within a boundary perimeter and which uses data developed from a graphic depiction representing the surface area to be treated would be an important advance in the art. A machine and method which recognizes that in certain situations, different areas within a boundary perimeter can beneficially be treated at differing frequencies and/or using differing cleaning regimens would be equally important.

OBJECTS OF THE INVENTION

It is an object of this invention to provide a machine and method which overcomes some of the problems and shortcomings of the prior art.

Another object of this invention is to provide a machine for treating a selected surface area within a boundary perimeter wherein the machine stores and uses data developed from a graphic depiction representing the surface area to be treated.

Still another object of this invention is to provide a machine wherein the graphic data may be developed by any one of several techniques.

Another object of this invention is to provide a machine for treating a selected surface area wherein the graphic data is loaded to the machine data file using a portable medium insertable into the machine.

Yet another object of this invention is to provide a machine for treating a selected surface area wherein such machine may include a position sensor for generating a feedback signal representing the actual position of the machine within a boundary perimeter.

Another object of this invention is to provide a method for vacuuming selected surface areas of carpet wherein main and secondary traffic areas are identified and wherein the frequency, within an overall vacuuming cycle, at which such main and secondary traffic areas are to be vacuumed.

These and other important objects will be apparent from the descriptions of this invention which follow.

SUMMARY OF THE INVENTION

In general, the inventive machine and method use graphic data which may be developed from a blueprint, line drawing or the like (in the nature of a pictorial representation) to perform the assigned function Such data depicts in coordinate form a surface area to be treated. This surface area may be a grassy area to be treated by mowing, a parking lot or street to be treated by sweeping or a carpeted area to be treated by vacuuming, to name but a few such possible areas. The machine may be said to be "automatic" or robotic in nature in that it determines the path to be followed from the coordinate-form data as well as from routing heuristics, machine parameters, e.g., width, turning radius, speed and the like After identification of a starting point, operation is initiated and surface treatment proceeds substantially unattended thereafter.

In one highly preferred embodiment, the machine is a carpet vacuuming machine and the coordinate-form data is derived from the CAMP® maintenance plan developed by Racine Industries, Inc., the assignee of this invention. In its known form, the CAMP® plan is developed from a blueprint of a building floor plan and provides printed pages showing plan views of carpeted rooms. Such pages also show color coded areas within such rooms which indicate the frequency of vacuuming. The CAMP® plan recognizes the fact that different areas of carpet (such as those at entry doors) soil more quickly than, for example, areas of carpet adjacent walls. The CAMP® plan establishes a schedule for selective vacuuming of selected areas. The operator of the vacuum machine, a professional carpet cleaner or housekeeping employee, follows the CAMP® plan (as reflected on the aforementioned printed pages) and vacuums designated areas at a designated frequency Because of the time and labor saved, this approach to surface treatment is much more economical than covering the entire area on each occasion of treatment.

A machine for treating a surface area within a boundary perimeter includes a self propelled chassis having a surface treating device mounted on it. A computing section is mounted on the chassis and a powered wheel (or each of plural powered wheels) has a motor module for receiving command signals from the computing section. A position sensor is coupled to the computing section for generating a feedback signal representing the actual position of the machine. .

A data loading device coacts with the computing section for transmitting data to such computing section The data loading device may be a floppy disk or other magnetic or non-magnetic media "readable" by the machine or it may be a modem which "loads" such data over a telephone line to which the machine is temporarily connected.

A data file stores graphic data developed from a graphic depiction representing the surface area to be treated. Such graphic data is identified below as the first set of digitized data. Depending on the type of area to be treated, the data file also stores data relating to an overall treating cycle and the frequency within such cycle at which selected areas are to be treated Data of this latter type is identified below as the second set of digitized data.

The data file coacts with the computing section and transmits graphic and other data to it. The computing section is arranged for processing the data and the feedback signal and responsively generating command signals directed to each motor module. Such modules, and the motors controlled thereby, propel the machine over the surface area selected to be treated.

In one highly preferred embodiment, the machine also includes an error alarm section and a keypad The error alarm section is coupled to the computing section and generates an error signal when the commanded position of the machine and its actual position differ The keypad is coupled to the computing section and permits manual entry of data such as day/date information, machine starting point and the like. Certain of such keypad-entered data is identified below as a third set of digitized data.

Preferably, graphic data is developed using a coordinate system which sets out the "X" and "Y" coordinate location of each important point. A sequence of points defines the boundary(ies) of areas to be treated. In one embodiment, the graphic data is developed using a cursor and a magnetic pick-up board. A drawing, such as a blueprint is affixed to the surface of the pick-up board and depicts the boundary perimeter and the area to be treated within the perimeter The board is coupled to a terminal arranged to carry out computer aided design (CAD) functions. One type of known cursor includes cross hairs etched on a transparent panel and a magnetic hoop surrounding the panel for generating a signal indicative of the location of the cross hair intersection point. The panel and the hoop are attached to an integral keypad.

The drawing scale is entered and thereafter, the cursor cross hairs are placed sequentially in registry with the intersection point of each pair of straight lines shown on the drawing If the boundary perimeter involves curved edges, the cross hairs are moved incrementally along the curved line, a sequence of point locations is developed and such points are later joined by short straight line segments. The location of each such point, whether of intersecting straight lines or along a curve is by the interaction of the cursor and the pick-up board. When properly keyed, the cursor emits a low level electromagnetic signal and the magnetic pick-up board detects such signal and is thereby able to determine the precise location of the cross hairs.

Graphic data may also be developed by scanning a line drawing of the surface area to be treated. Such scanning techniques are used in the older wirephoto process or in the more recent facsimile transmission process.

Another way in which the graphic data is developed is by imaging a drawing of the boundary perimeter and the surface area selected for treatment within the boundary perimeter. The image is applied to a surface which has an array of light sensors thereon The sensors distinguish the locations of blackened drawing lines—depicting curbs, sidewalks, walls or the like—from brightly illuminated areas which portray the surface area to be treated. Further details regarding imaging techniques are set forth below.

Such graphic data is most readily used when it is "digitized," i.e., rendered in a binary code system usable by computers and microprocessors. Digitized data may be embedded in a portable medium, a floppy disk or tape for example, to be inserted into the machine. Such data may also be embedded in such a medium using lasers or, as described above, it may be loaded directly from the CAD terminal to the machine data file by transferring the data from a remote location over a telephone line.

Commercial carpet vacuuming involves problems not present in the treatment of many other types of surface areas. For example, grassy areas and streets are usually treated the same way on each occasion and the machine is capable of treatment in such a way. In contrast, economical carpet vacuuming is performed in recognition of the fact that different areas soil at different rates. As a consequence, the various areas of a carpet can be vacuumed with different frequencies. Highly effective carpet cleaning is the result and the savings in time and labor are truly significant.

Merely by way of example, the inventive method is described in connection with vacuuming selected surface areas of carpet. The method includes the steps of providing a vacuum cleaning machine including a self propelled chassis having vacuum cleaning apparatus mounted thereon. The machine also includes a computing section, a plurality of powered wheels and associated motor modules, a position sensor and a data file as described above.

A first set of digitized data is developed from a graphic depiction of the carpeted area to be vacuumed. Such data includes coordinates representing main and secondary traffic areas. Optionally (and as described below), the data may also include coordinates representing tertiary traffic areas. A second set of digitized data is also developed and represents an overall vacuuming cycle, e.g., one week, and the frequency (e.g., seven times per week or once per week) within such cycle at which each type of traffic area is to be vacuumed. The first and second sets of digitized data can be developed in either order.

In an alternate embodiment, the second set of digitized data is enhanced in recognition of the fact that frequency may be but one component of a cleaning regimen That is, a cleaning regimen may also recognize vacuuming "intensity." As used herein, the term "frequency" means the number of treatments for each overall vacuuming cycle and the term "intensity" means the rate at which a machine moves across the carpet and/or the number of "passes" to be made by the machine over a given area during each treatment.

A third set of digitized data is also developed and represents the day within the overall vacuuming cycle on which vacuuming is then being initiated. The first, second and third sets of digitized data are loaded into the computing section, are processed and command signals are responsively generated. These command signals are directed to the motor modules for propelling the machine over the surface area selected to be vacuumed.

It is to be appreciated that main traffic areas may be vacuumed more frequently, e.g., daily or every business day, while secondary traffic areas may be vacuumed less frequently, e.g., weekly. More common CAMP® plans specify that all carpeted areas be vacuumed daily or weekly. Thus, such plans recognize only two types of traffic areas, i.e., main and secondary, and are based on a weekly overall vacuuming cycle. However, CAMP® plans are readily developed to recognize a third or tertiary traffic area. Tertiary traffic areas may be identified as those which are rarely walked upon or otherwise soiled, e.g., those next to walls, and which need only occasional vacuuming, monthly for example.

To cite an example, it is assumed that the CAMP® plan sets out a weekly overall vacuuming cycle Such plan requires that main traffic areas are to be vacuumed Monday through Friday and that all other areas are to be vacuumed only on the last day of the vacuuming cycle, e.g., Friday. Further assuming that the particular day on which vacuuming is being initiated is a Tuesday (and that such is not the last day of the vacuuming cycle), only the main traffic areas will be vacuumed If vacuuming is initiated on a Friday (and such is the last day of the vacuuming cycle), all traffic areas will be vacuumed.

To cite another, less common example, it is assumed that main traffic areas are to be vacuumed Monday through Friday, secondary areas on Friday only and tertiery areas on the last day of the vacuuming cycle which is one month. Further assuming that the particular day on which vacuuming is being initiated is a Tuesday (and that such is not the last day of the vacuuming cycle), only the main traffic areas will be vacuumed. If vacuuming is initiated on a Friday (and such is not the last day of the vacuuming cycle), the main and secondary traffic areas will be vacuumed. If such Friday happened to be the last day of the vacuuming cycle, all three types of areas will be vacuumed.

Further details regarding the inventive machine and method are set forth below.

DETAILED DESCRIPTIONS OF PREFERRED EMBODIMENTS

Figure 4:
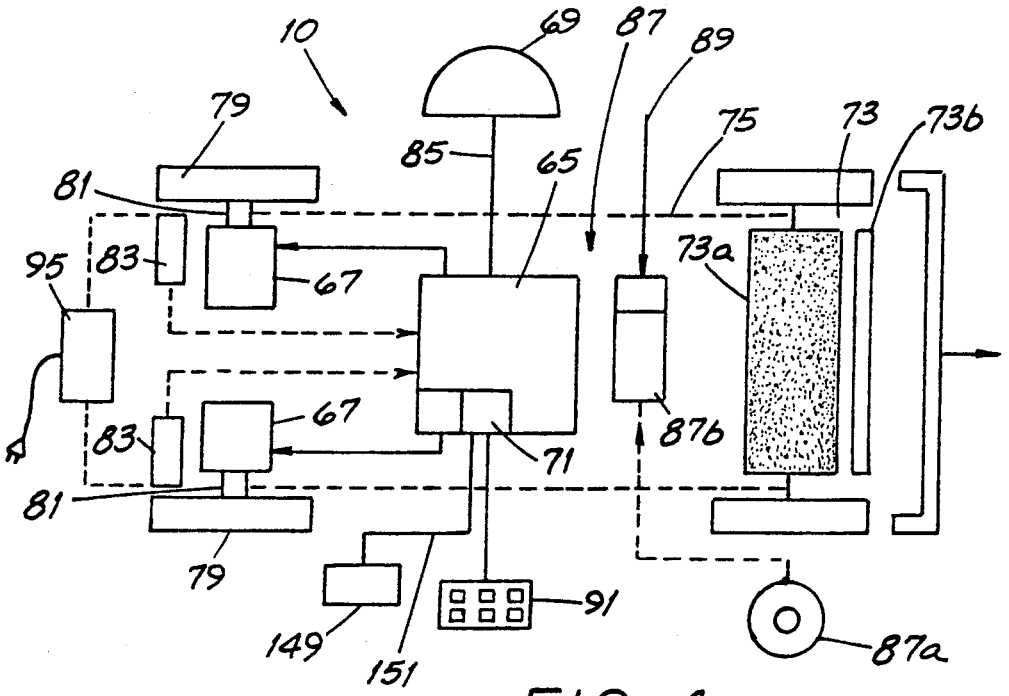
FIG. 4 is a simplified top plan view of an embodiment of a machine used for treating surfaces areas in accordance with the invention.

Before explaining the details of the inventive machine 10 and method, it will be helpful to have an understanding of some of the types and characteristics of surface areas which may thereby be automatically treated using graphic data.

A few examples of surface areas which may be treated using the inventive machine 10 and method include parking lots, streets, grassy playground areas, golf courses, marble or other hard surface floors and carpeted areas. Such areas are frequently depicted in existing drawings or blueprints or such drawings or blueprints may be readily created.

Such areas usually involve features which obstruct surface treatment operations, at least to some degree, and such features must be recognized. When mowing golf course fairways or other grassy areas, for example, the surface treating process preferably recognizes obstacles such as trees and sand traps. While golf course greens may not constitute an obstacle, they are subject to a different type of treatment (in the form of special mowing) than is used on fairways. Parking lot sweeping operations need to recognize the locations of vehicle wheel barriers and, of course, all such surface treatment operations are conducted within a defined boundary perimeter.

Surface treatment of hard surface floor areas and of carpeted areas is subject to similar constraints in that surface treatment activities need to recognize obstacles as well as the boundaries of the areas to be treated. However, carpet vacuuming also involves additional, unique characteristics which if properly recognized will result in carpet which is vacuumed at dramatically reduced costs while yet maintaining the carpet at a high state of cleanliness. Therefore, the inventive machine 10 and method are primarily described with respect to carpet vacuuming operations. However, such machine 10 and method are readily adaptable to removal of dirt from carpet by means other than vacuuming. Therefore, as used herein, "vacuum" and derivatives thereof mean activity for removing dirt from carpet. A machine 10 and method suitable for treatment of other types of surfaces, less complex in treatment approach, will be apparent from the following.

As briefly described above and referring to FIG. 1, carpets have what are termed main traffic areas 11 and secondary traffic areas 13 and the usual locations of such areas 11, 13 and their soiling characteristics will now be explained. It is known that those carpeted areas adjacent exterior doorways 15 represent a particular type of main traffic area 11, often called a "track off area 11*a*." At the end adjacent the doorway 15, these bullet-shaped track off areas 11*a* have a width which approximates that of the doorway 15. Such areas 11*a* taper to a somewhat blunted interior end and are caused by dirt and grime being tracked into the building (or from non-carpeted areas within the building) and transferred from shoes to the carpet surface.

Carpeted areas at interior doorways such as doorway 17 leading to an office 19 or the like represent another type of main traffic area 11 known as a "funnel area 11*b*." These funnel 11*b* areas resemble a bow tie or an hourglass in shape and are caused by dirt being deposited from shoes to the carpet surface as people enter and exit the office 19.

In addition to track off areas 11*a* and funnel areas 11*b*, carpets also have other types of main traffic areas 11 which are less predictable in shape but which also comprise portions of the carpet most frequently walked upon by occupants of the building. More rapidly and heavily soiled main traffic areas also include common aisleways, hallways and carpeted areas in front of coat racks.

Carpets also have what may be called "secondary traffic areas" such as the area 13. These are portions of the carpet less frequently walked upon than main traffic areas 11 but which nevertheless undergo moderate use or become soiled for other reasons such as by the mere settling of dust.

The number of floors of a building and the particular floor in which a carpeted area is located also has a bearing upon the rate at which carpet soils and requires cleaning. Carpeted areas on the first floor and floors above but near the first floor of a building tend to become soiled more rapidly than carpets which are more remote from the first floor. However, all such carpets will exhibit track off areas 11*a*, funnel areas 11*b* and other types of main traffic areas 11 (as well as secondary traffic areas 13) in their characteristic soiling patterns.

Given the layout of a particular room or rooms and knowing how such room(s) are used, a person of reasonable experience in the carpet cleaning field can accurately predict those portions of the carpet which are main traffic areas 11 (including track off areas 11*a* and funnel areas 11*b*) and which are secondary traffic areas 13. Each type of area 11, 13 is kept clean using a different vacuuming frequency. In a highly preferred vacuuming strategy, main traffic areas 11 are vacuumed daily while secondary traffic areas 13 are vacuumed weekly. To state it another way, the ideal carpet surface treating strategy recognizes the fact of carpet soiling at differing rates and provides for carpet cleaning at a frequency commensurate with the rate at which the carpet becomes soiled. Selective tailoring of carpet vacuuming strategies to the patterns of carpet soiling is known per se and printed plans for performing carpet vacuuming and cleaning on this basis are sold as the aforementioned CAMP® maintenance plans by Racine Industries, Inc., Racine, Wis.

Figure 3:
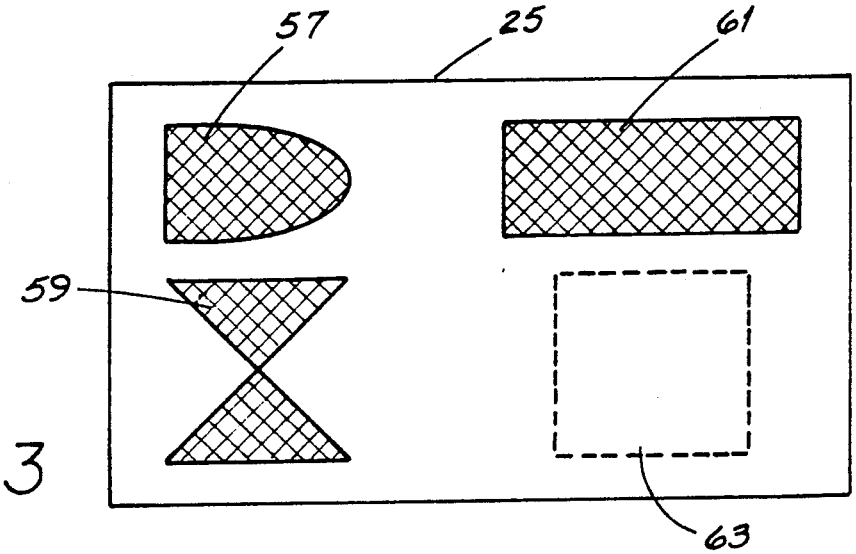
FIG. 3 is a pictorial depiction of a menu card having magnetized graphic symbols thereon which are used for providing graphic data representing selected surface areas.

Referring additionally to FIG. 3, a CAMP® maintenance plan defines various parameters of surface areas to be treated, namely, carpeted floors. Such plans are developed using a coordinate-based system involving a magnetic pick-up board 21 and cursor 23, a menu card 25, architectural CAD computer equipment and a blueprint drawing 29 of the carpeted area and related structural features. Such plans are manifested in "hard copy" form using a CAD-driven printer equipped with ink fonts of various colors and are used by vacuum machine operators in such printed form. Such CAMP® plans are supplemented with a printed scheduling calendar and are carried out using fully attended, operator propelled vacuuming equipment.

DEVELOPMENT OF THE GRAPHIC DATA

Figure 1:
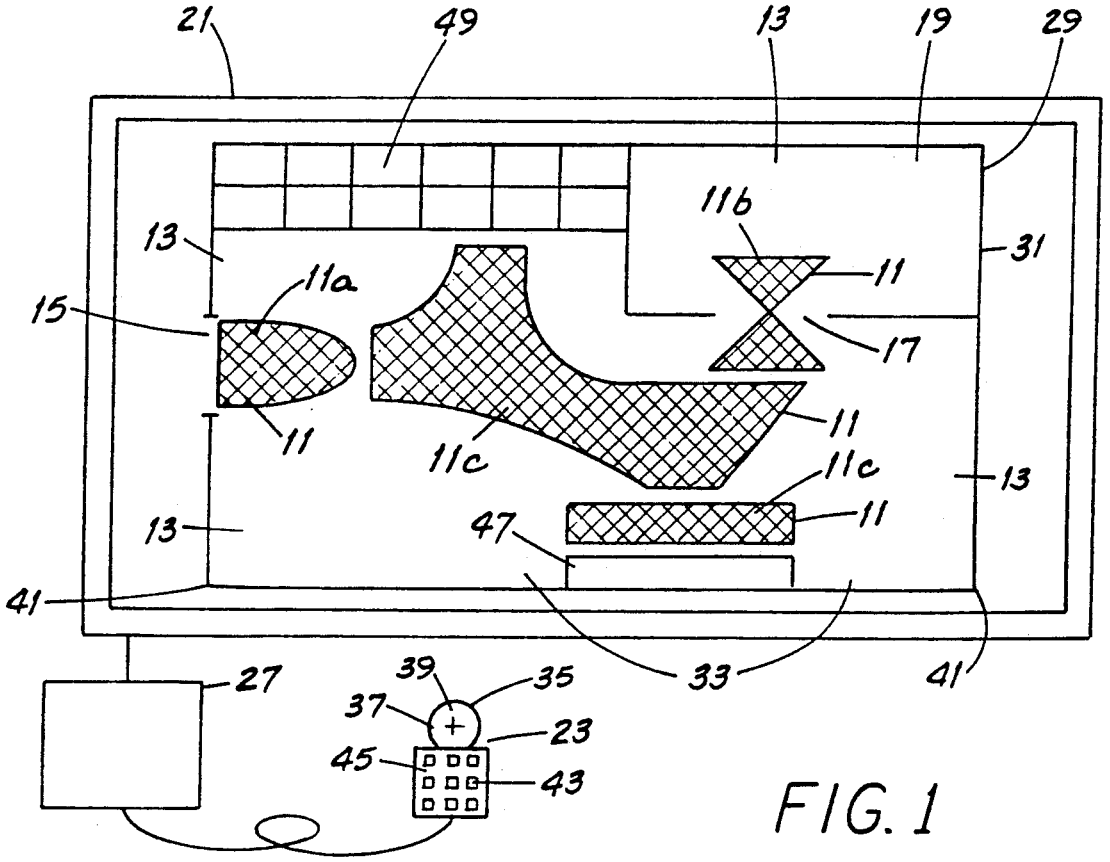
FIG. 1 is a front elevation pictorial view showing a cursor and magnetic pick-up board arrangement for providing graphic data from a blueprint affixed to the board.

Referring further to FIG. 1, development of the graphic data begins with a blueprint drawing 29 or other type of drawing of the area to be treated. Virtually all areas which may be subjected to surface treating activity have been portrayed in a graphic depiction of some type. For example, golf courses are depicted in blue print type construction drawings which locate greens, sandtraps and the like. Parking lots and buildings are similarly drawn to scale prior to construction and the resulting blueprints depict not only the size of the surface areas but most of the significant obstacles associated with each. Occasionally, actual construction does not precisely follow the blueprint rendition and in such instances, the blueprint or drawing must be modified to depict the construction "as built."

If a surface area to be treated has not been graphically depicted as in a blueprint, a scale blueprint or line drawing is created and the attendant cost will be offset by savings arising from the use of the inventive machine and method.

Once the appropriate blueprint 29 or drawing is on hand, the graphic data is developed. Such development is performed in two phases, the first of which is to develop a representation of the boundary perimeter and of the overall arrangement of the surface area 33 to be treated. In the second phase, special features of the surface area 33 are recognized and developed. In a carpeted area, such special features include the main and secondary traffic areas 11, 13.

There are several ways to.develop digitized graphic data of the perimeter 31 and overall arrangement from a graphic depiction such as a blueprint 29. One way is by the use of a magnetic pick-up board 21 and a cursor 23. The magnetic pick-up board 21 (of a known type) includes an array of magnetic sensors (not shown) located just below the upper surface of the board 21. A blueprint 29 of the surface area 33 to be treated, a simple office area for example, is attached to the board 21 so that the graphic depiction of the surface area 33 is evenly, squarely located thereon.

A hand held cursor 23 includes a magnetic ring 35, a transparent panel 37 and intersecting cross hairs 39 etched on the panel 37. The cross hairs 39 are positioned over the intersection point of two straight lines, the room corners 41 for example, and a key 43 is depressed to automatically record the location of such intersection point as a set of coordinates represented in digitized data form. After so locating two such points, the keyboard 45 is actuated and the architectural CAD computer 27 system to which the board 21 and the cursor 23 are connected draws a straight line between the two points.

The layout of the entire room is developed in this and will include the locations of the exterior door way 15, of an interior office door 17, of ancillary items such as a coat rack 47 and of any tiled area 49 or other non-carpeted, hard surface floors. In the exemplary room surface area 33 of FIGURE 1, all parts thereof are assumed to be carpeted except the tiled area 49.

Figure 2:
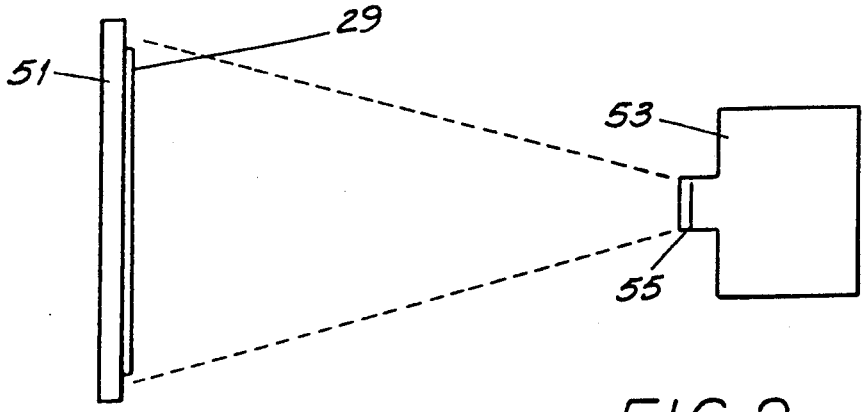
FIG. 2 is a simplified side elevation view of a light projector and light sensitive board used for providing graphic data using imaging techniques.

In another preferred embodiment, such graphic data is developed by imaging the surface area 33 upon a light sensitive surface. Referring to FIG. 2, a blueprint 29 or line drawing of the boundary perimeter 3! and surface area 33 to be treated is affixed to a board 5I having an array of light sensors disposed thereon. The lines which form such graphic depiction are preferably rendered in intense black for better accuracy. A high intensity lamp 53 projects light to the drawing 29, the board 51 detects the location of blackened lines on the drawing 29 and the CAD computer 27 resolves the resulting signals to coordinates representing the depicted area 33.

Still another way that such graphic data is developed by imaging to a light sensitive surface is by projecting a transparency 55 of the black line drawing 29 to the light sensitive board 51. Projection of 35mm slides to a screen is somewhat analogous and the arrangement of FIG. 2 is similar. The difference is that in the description set out above, a drawing 29 is mounted on the board 51. In this description involving projecting a transparency 55, the transparency 55 is placed at a location immediately adjacent the lamp 53. Light sensors on the board 51 detect the locations of the black lines and the CAD computer 27 digitizes and resolves this information as described above.

Yet another way to develop such graphic data is by scanning a sharply contrasting line drawing 29 of the surface area 33 to detect and digitize the location of such lines. Known facsimile machines and wirephoto machines used such a scanning technique.

After developing digitized data which represents the overall arrangement of the boundary perimeter 31 and of the surface area 33 to be treated, any special features are similarly developed as digitized data. Referring again to FIG. 3, the menu card 25 includes graphic symbols 57, 59, 61 for a track off area 11*a*, a funnel area 11*b* and a path 11*c* or aisle-type of main traffic area 11, respectively. Such menu card 25 may also include a symbol 63 for any structure which might impede unattended surface treatment Such structure may include a building column or a table, for example.

Using the blueprint 29, magnetic pick-up board 21 and cursor 23, a particular symbol 57, 59, 61, 63 can be magnetically "lifted" from the card 25 and "transferred" to the appropriate location on the blueprint 29. This is done by placing the cursor 23 over the symbol, properly keying the keyboard 45, relocating the cursor 23 over that location on the blueprint 29 where the symbol is to appear and again keying the keyboard 45. Provisions are made for increasing or decreasing the size of the symbol, as necessary to fit the blueprint 29. Such activity digitizes the size and location of the symbol within the CAD computer 27 and in a coordinate system.

Development of the first set of digitized data of the carpet area to be vacuumed is complete when the overall arrangement of the surface area 33 to be treated and the location of special features or areas within such area 33 have been resolved to a digitized coordinate system within the CAD computer 27. In a highly preferred embodiment, such data includes coordinates representing main traffic areas such as those areas represented by the symbols 57, 59 and 61 of FIG. 3. Such coordinates also represent secondary traffic areas 13 such as the relatively large expanse of carpet in FIGURE 1 on which no symbol has been placed.

When viewing FIG. 1, it is to be appreciated that the blueprint 29 shown therein is conventional and does not include in printed form the main and secondary traffic areas 11, 13. The blueprint 29 of FIGURE 1, with main and secondary traffic areas 11, 13 included therein, is represented by the first set of digitized data.

Figure 6:
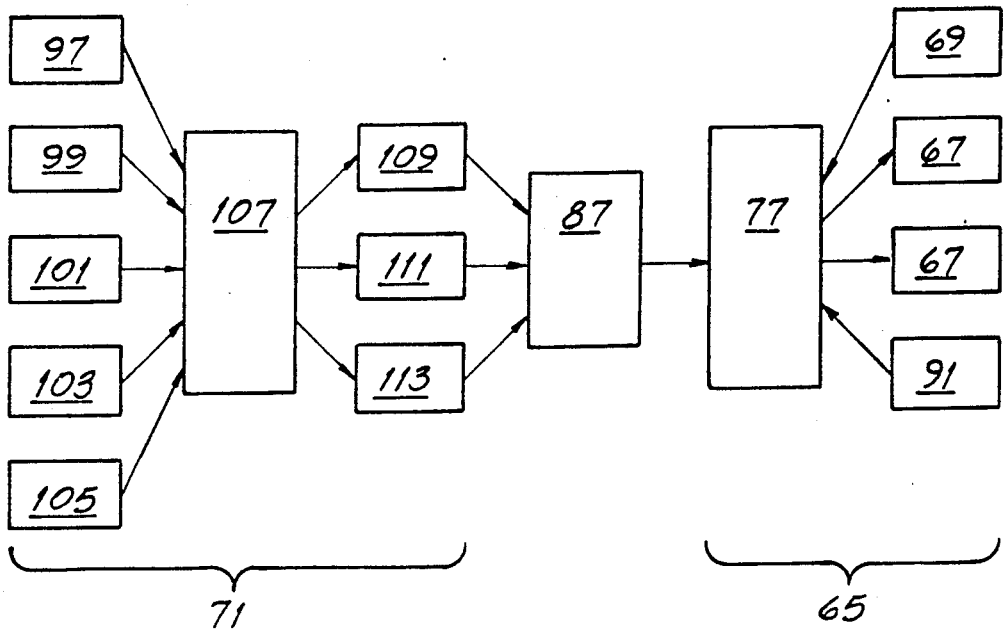
FIG. 6 is a block diagram circuit showing the data file, the loading device and the computing section components of the machine.

Referring to FIGURES 1, 4 and 6 and continuing the use of carpet vacuuming as the exemplary surface treatment of an area 33, a second set of digitized data is developed to represent an overall vacuuming cycle and the cleaning regimen within such overall vacuuming cycle at which the main traffic areas 11 and the secondary traffic areas 13 are to be vacuumed. In a highly preferred embodiment, such cleaning regimen includes components identifying both frequency and intensity for both types of traffic areas Such data is arranged with a default condition so that, as described below, if the operator either fails to select an intensity (number of passes and/or machine speed) or believes that such selection is unnecessary in the circumstance, the machine 10 will make a single pass across the carpet at the standard travel rate.

For example, main traffic areas 11 such as the track off area 11*a*, the funnel area 11*b* and the main aisle area or path 11*c* normally require daily vacuuming. Secondary traffic areas 13 need only weekly vacuuming. The first and second sets of digitized data can be developed in either order and are then loaded into a computing section 65 located on the machine 10.

While the development of the third set of digitized data will be explained in greater detail in connection with the description of the machine 10 below, such third set of data represents the day within the overall vacuuming cycle on which vacuuming is then being initiated. Following development of such third set of data, it is loaded into the computing section 65

After the first, second and third sets of data are developed and loaded, such data sets are processed and a command signal is responsively generated. This command signal is directed to the motor modules 67 for propelling the machine 10 over those portions of the surface area 33 selected to be vacuumed.

In selected situations involving very regularly shaped areas to be treated, the machine 10 can treat such areas successfully without the use of position feedback signals. However, the treatment of most areas (such as area 33) requires that the feedback signal from the position sensor 69 also be processed to help assure that the actual position of the machine 10 and the coordinate position "assumed" by the computing section 65 are generally the same. If they are not, an alarm is actuated and the computing section 65 reset by the operator In a highly preferred embodiment, a data file 71 also has stored therein the machine parameters and routing heuristics or "rules" by which the machine 10 is directed over surface areas to be treated. Examples of machine parameters include width, mimimum turning radius, speed and stopping distance.

As to routing heuristics, such may vary depending upon the shape defined by the perimeter of the area to be treated. As examples, football fields (which require periodic mowing) and many carpeted rooms (which require periodic vacuuming) are rectangular. In such instances, the heuristic rules preferable require the machine 10 to make sequential straight line, parallel "passes" of generally equal length over the surface. Each such pass is preferably positioned to slightly overlap with the preceding pass so that no areas are missed. Surface areas having other shapes, circular or irregular, are covered using such straight line passes but of unequal length. In the alternative, a generally spiral pattern is used for a circular room.

THE SURFACE TREATING MACHINE

Referring to FIG. 4, an exemplary surface treating machine 10 is embodied as a carpet vacuuming machine having a working head 73 mounted thereon and including a rotary brush 73*a* and an elongate vacuum nozzle 73*b*. However, it will readily be appreciated that a similar machine 10 may be embodied to have one of several other types of working heads 73 such as a mower blade or brushes as for a street and parking lot sweeping machine. Such machines are well known per se.

The machine 10 includes a chassis 75 which is symbolically depicted in dotted line to better illustrate certain features of the invention. A computing section 65 is mounted on the chassis 75 and is preferably embodied to include a microprocessor 77 together with other sections described below in connection with the explanation of FIG. 6. The machine 10 also includes a pair of powered wheels 79 mounted on the chassis 75, each wheel 79 having a motor module 67 for receiving command signals from the computing section 65.

In a preferred embodiment, the motor module 67 is of the "stepper" or servo type wherein the motor shaft 81 (coupled to a wheel 79) rotates a predetermined number of degrees for each received signal. Since such motor modules 67 have a shaft 81 which rotates as commanded, the need for a rotation feedback signal is obviated for most applications. However, rotation feedback sensors 83 are shown for use with motor modules 67 of other types.

A position sensor 69 is coupled to the computing section 65 and generates a feedback signal representing the actual position of the machine 10. As shown symbolically in FIG. 4, the position sensor 69 appears to extend to the side of the machine 10. In a highly preferred embodiment, the position sensor 69 and it support pedestal 85 actually extend upwardly from the machine 10 and tend to resemble a mushroom in shape. Further details regarding such position sensor 69 are set forth below in connection with the explanation of FIGURE 5.

A data loading device 87 coacts with the computing section 65 for transmitting data to such computing section 65. Depending upon the embodiment, the loading device 87 will or will not be a mounted part of the machine 10 even though it is symbolically shown as part of the machine 10 in FIG. 4. One type of loading device 87 is a magnetic disc 87*a* and reader 87*b*, the latter being mounted on the machine 10. The disc 87*a* is inserted in the reader 87*b* for transmitting data to the computing section 65. A variation of this arrangement involves the use of a nonmagnetic disc in which information is embedded by laser, much like present day compact discs ("CD's").

Another type of loading device 87 is a modem and such modem is at a remote location and transmits data to the computing section 65 over a telephone line in a known manner. When a modem is so used, the machine 10 is plugged to a telephone jack 89 for loading. Yet another type of loading device 87 is a "read-only" memory or ROM card. Such a card has information from a data file embedded therein and is inserted into an appropriate slot in the machine 10 for "reading" by the microprocessor.

In the case of a disc (like disc 87*a*) or ROM card, such discs or cards are "dedicated" to a particular surface area or group of surface areas such as a floor or several floors of a building. When preparing to treat a surface area at a particular site, the operator selects the disc 87*a* or card for such site.

The data file 71 has stored therein the graphic data developed from a graphic depiction which represents the surface area, e.g., a carpeted floor area 33, to be treated. The data file 71 coacts with the loading device 87 for transmitting such graphic data to the computing section 65. Further details regarding the data file 71 are set forth below in connection with the explanation of FIG. 6.

It will be recalled from the description above that a third set of digitized data represents the day within an overall vacuuming cycle on which vacuuming is then being initiated. The operator develops such data by entering information into an onboard keypad 91 to denote the day of the week on which the machine is then being used. The operator may also enter additional information to denote the intensity (in number of "passes" and/or machine speed) at which the carpet is to be cleaned. In the absence of such additional information, one-pass vacuuming at the standard travel rate will occur. Since the second set of digitized data represents the overall vacuuming cycle as well as the cleaning regimen within such cycle by which certain areas are to be vacuumed, the computing section 65 uses the third set of data to select the coordinate groups representing those areas to be vacuumed on a particular day.

An automatic shutoff bar 93 is mounted at the front of the machine 10 to stop its motion in the event the machine 10 inadvertently contacts an obstacle. Motive power for the machine 10 is supplied in a known manner by an onboard battery (not shown) or by a cable reel 95 connectable to a wall socket or to another source of power.

A preferred carpet vacuuming machine 10 made in accordance with the invention has a width not in excess of about 28 inches for readily passing through doorways. For improved stability and resistance to tipping, its height is not in excess of its width. Such machine 10 makes a 180° turn substantially in its own width by maintaining one powered wheel 79 stationary and energizing the other powered wheel 79 until the turn is completed. Such 180° turns within a dimension less than its own width (so called "centerpoint" turns) are by differentially or uniformly counter rotating the wheels 79.

The machine 10 has a grade climbing capability adequate to negotiate commonly occurring wheelchair ramps found in commercial and industrial buildings. Its travel speed is selected to be between 1 foot per second (fps) and 5 fps with about 2 fps being preferred as a standard rate. The machine may also have a slower rate of travel, e.g., 1 fps, for use when the operator enters information by the keypad 91 indicating more intense cleaning is desired.

Referring to FIG. 6, the data file 71 and computing section 65 will now be explained in greater detail. The data file 71 has embedded therein most of the information needed for the machine 10 to perform its task and such file 71 will be described with respect to a carpet vacuuming machine 10. That set of graphic data depicting the floor plan and permanent obstacles (support pillars, walls and the like) is identified as 97 and is based on the aforementioned CAMP® maintenance plan.

The calendar for cleaning, identified as 99, and the cleaning frequency, identified as 101, are established by the human designer of the CAMP® plan based on judgment and experience. This information is embedded in the data file 71. It is preferred in most situations that all carpeted areas 11, 13 be vacuume.d at least once per week and that main traffic areas 11 be vacuumed daily. In fact, in certain climates or environments more frequent vacuuming of certain main traffic areas 11 is highly desirable. For example, carpeting at the main entrances of a hotel in a beach area may be scheduled for vacuuming several times daily since embedded sand is particularly destructive to carpet. Main entrances of public buildings in northern climates may also be scheduled for vacuuming several times daily during winter months since salt and snow are especially injurious to carpets.

Routing heuristics, identified as 103, and specific details of the machine, identified as 105, are also embedded in the data file 71 although details 105 can be embedded in the microprocessor 77 since they will not change for a particular machine 10. If the heuristics 103 are comprehensive for a wide variety of room shapes, such heuristics 103 could likewise be embedded in the microprocessor 77.

For areas having a square or rectangular boundary area (developed from the graphic data depicting the area to be treated), the heuristic rules require the machine 10 to make sequential straight line, parallel "passes" of generally equal length over the surface. Each such pass is positioned to slightly overlap the preceding pass so that no areas are missed. For surface areas having differently shaped boundary perimeters defined by non-perpendicular straight lines and/or or a combination of straight and curved lines, such rules require such areas to be treated using such straight line passes but of unequal length. For surface areas which are circular and unobstructed, such rules require treatment using a generally spiral pattern.

Specific details of the machine 10 include machine width, minimum turning radius, travel speed and stopping distance. The latter detail is needed to permit the machine to "anticipate" a stop or turn and de-energize or slow the drive wheels 79 even though the vacuuming function continues.

Figure 7:
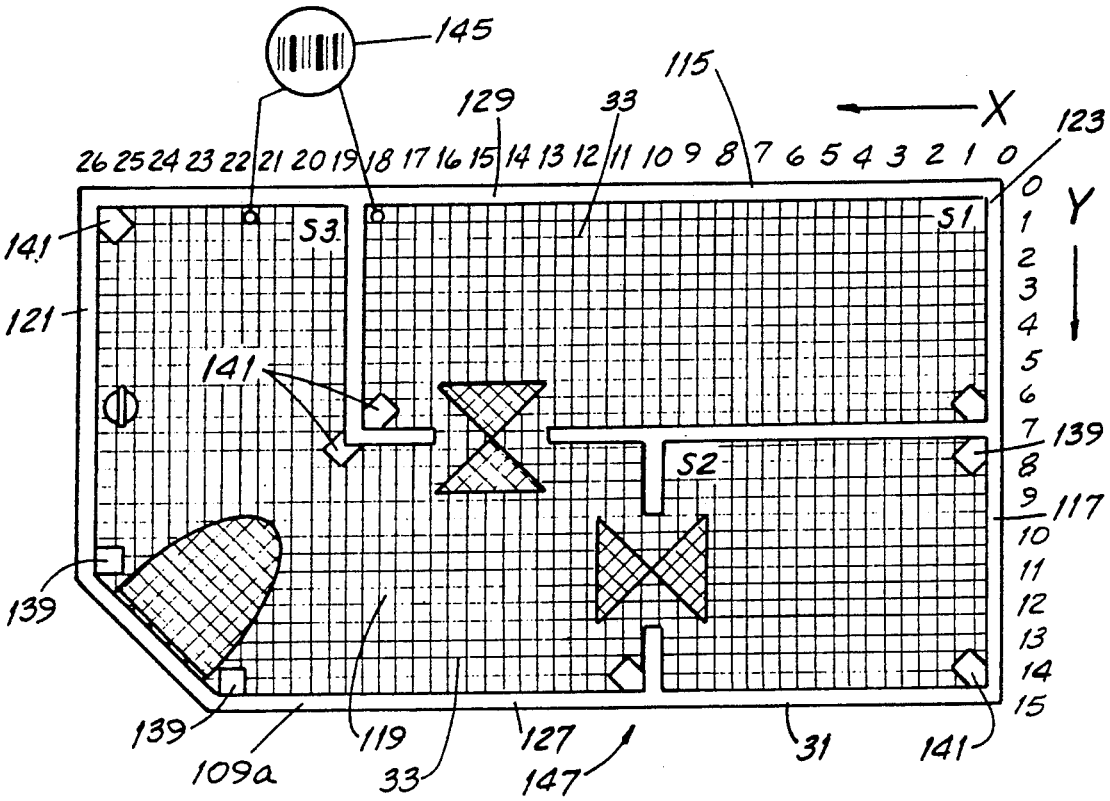
FIG. 7 is a simplied top plan view of a carpeted room showing main traffic areas, secondary traffic areas and a grid coordinate system.

Referring additionally to FIG. 7, the foregoing graphic data, cleaning frequency, cleaning calendar, routing heuristics and machine details are provided as inputs to a conversion section 107. Section 107 can be loaded into the machine 10 for use or permanently embedded in the microprocessor 77. Section 107 uses such information to generate a digitized grid map, identified as 109, a coordinate table, identified as 111, and what is called a "next-position" table, identified as 113. An exemplary grid map 109 is shown in FIG. 7 while an exemplary coordinate table 111*a* and an exemplary next-position table 113*a* are set out below as Tables 1 and 2 respectively.

TABLE 1

AREA 1

| X | Y | VACUUM CYCLE | POSITION INFORMATION |
|---|---|---|---|
| 0 | 0 | 7 days | L = 17.0, R = 00.0, F = 00.0, B = 8.0 |
| 0 | 1 | 7 days | L = 17.0, R = 00.0, F = 01.0, B = 7.0 |
| 0 | 2 | 7 days | L = 17.0, R = 00.0, F = 02.0, B = 6.0 |
| 0 | 3 | 7 days | L = 17.0, R = 00.0, F = 03.0, B = 5.0 |
| 0 | n | | L = , R = , F = , B = |
| 1 | 0 | | L = 16.0, R = 01.0, F = 00.0, B = 8.0 |
| 1 | 1 | | L = 16.0, R = 01.0, F = 01.0, B = 7.0 |
| 1 | 2 | | L = 16.0, R = 01.0, F = 02.0, B = 6.0 |
| 1 | 3 | | L = 16.0, R = 01.0, F = 03.0, B = 5.0 |
| | . | | L = , R = , F = , B = |
| 1 | n | | L = , R = , F = , B = |

TABLE 1-continued

| X | Y | VACUUM CYCLE | AREA 1 POSITION INFORMATION |
|---|---|---|---|
| n | n | | L = , R = , F = , B = |

TABLE 2

| AREA 1 No. | Next Position |
|---|---|
| 1 | X = 0, Y = 0 |
| 2 | X = 0, Y = 1 |
| 3 | X = 0, Y = 2 |
| 4 | X = 0, Y = 3 |
| 5 | X = 0, Y = 4 |
| 6 | X = 0, Y = 5 |
| 7 | X = 0, Y = 6 |
| 8 | X = 0, Y = 7 |
| 9 | X = 0, Y = 8 |
| . | X = , Y = |
| . | X = , Y = |
| . | X = , Y = |
| n | X = , Y = |

The map 109 and the tables 111 and 113 (Tables 1 and 2, respectively) are embedded in the data file 71. The grid map 109*a* is divided to relatively small areas using an X-Y coordinate system having an "X" axis 116 and a "Y" axis 117. Each axis 115, 117 is marked in ascending increments which may coincide with actual units of measurement, feet for example, or which may be arbitrary.

Table 1 is derived from the plan 109 and for each coordinate (such as coordinate 119 where x=17 , y=11) provides data indicating the distance of such coordinate from the left, right, front and back walls (walls 121, 123, 127 and 129, respectively). Such distances may be in arbitrary or actual units of measure. For example, the location of coordinate X=0, Y=2 is 26 units from the left wall 121, zero units from the right wall 123, 2 units from the back wall 129 and 13 units from the front wall 127.

In position sequence, the computing section 65 "looks up" the next position as reflected in Table 2. It uses such next position information to select the line of Table 1 (and the related coordinates) to position the machine 10.

Treating of certain types of surface areas is straightforward in that they are free or substantially free of obstruction and are of such a nature and use that the entire surface of the entire area is treated the same way for each treatment operation. Many parking lot arrangements lend themselves to such surface treatment. For such surface areas, slight inaccuracies in the location of the machine (such as machine 10) do not generally cause a problem. Such inaccuracies may result from cumulative errors in the feedback signal or such errors may result from inadvertent machine displacement caused by, for example, striking a small object on the surface. Unobstructed expanses of carpet represent another such situation.

More typically, the surface to be treated will include at least a few obstructions, the locations of which must be recognized in conducting the surface treating activity. If a carpet is to be vacuumed most economically, it is necessary to consider track off areas 11a, funnel areas llb and other main traffic areas 11 which become soiled more rapidly then secondary traffic areas 13. Such considerations are important to control costs since, as pointed out above, secondary traffic areas 13 do not need to be vacuumed as frequently as main traffic areas 11. Additionally, the locations of these different types of traffic areas need to be rather precisely determined to help prevent unneeded or incomplete vacuuming.

Accordingly and referring to FIGS. 4, 5, 6 and 7, the machine 10 also includes a position sensor 69 coupled to the computing section 65 for generating a position signal which represents the position of the machine 10 within the perimeter of the room or other surface to be treated. The position sensor 69 preferably includes a turret-like structure 131 in which is mounted one or more means 133 for generating a position signal. As examples, the structure 131 may include a sonar transmitter 133*a* which emits bursts of ultrasonic signals 135 and receives reflected signals 135*a*. The time lapse between transmission and reception permits determination of the distance between the structure 131 and an object. Sonar is more useful within an enclosed space such as a room.

Another type of position sensor 69 involves the use of radiated infrared (IR) light 137 and passive, reflective "targets 139." Such a position sensor may also use coherent or laser light. Irrespective of whether IR or laser light is used, the reflective targets 139 are placed in predetermined locations about the perimeter which bounds the surface area 33 or within such perimeter. Such targets 139 may be mounted on walls or on free-standing pylons within or about the perimeter. Bursts of IR light 137 are emitted by and reflected light 137*a* is detected by the sensor 133*b*.

Still another type of position sensor 69 involves the use of active, periodically-transmitting beacons 141 placed in predetermined locations along the perimeter 31 of a room or an open space or within such perimeter 31. Such beacons 141 may be mounted on walls 121, 123, 127 and 129 or pylons as described above. Reception of a signal 137*a* or 143 from two such reflective targets 139 or beacons 141 permits computation of the machine position by triangulation.

Yet another type of position sensor 69 involves the use of passive, coded symbols 145. Such symbols may be similar to the Universal Product Code (UPC) bar symbols although the precise form of the symbols 145 is a matter of choice. Each such symbol 145 is particularized for a location within a room and is mounted at such location by a wall placard or the like. The symbols 145 are scanned by one or more scanning heads 133*d* located on the position sensor 69 for conversion to coordinates representing a machine location.

Figure 5:
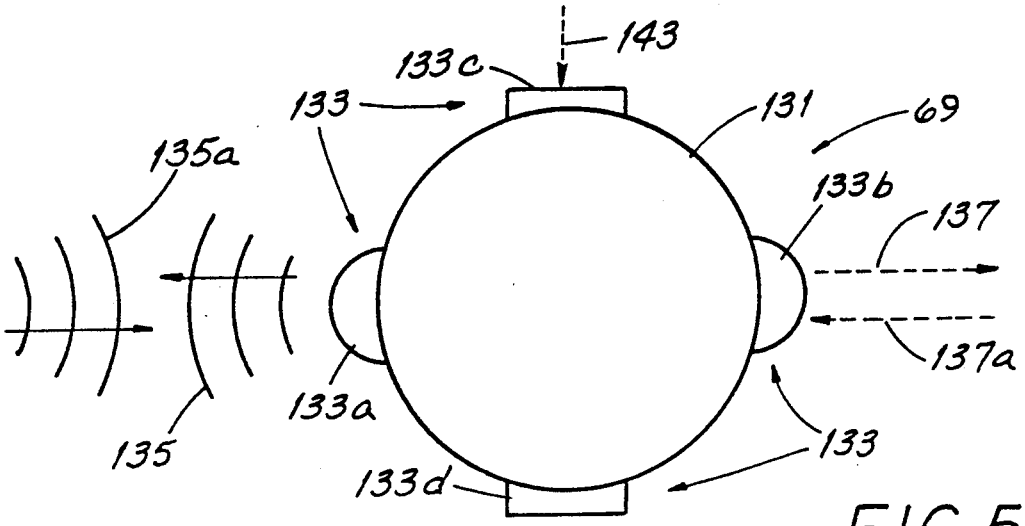
FIG. 5 is a simplified top plan view of a position sensor which is optionally used in connection with the machine of FIG. 4.

When considering FIG. 5, it is to be appreciated that the illustration of only one position sensor 133*a*–133*d* of each of the foregoing types is representative. In practice, a number of sensors of one or more of the foregoing types are arranged in slightly spaced-apart locations about the perimeter of the position sensor 69. Such arrangement provides an omnidirectional capability.

The position sensor 69 can be used in either or both of two ways. One way such a sensor 69 may be used is to place the surface treating machine 10 anywhere upon the surface area 33 to be treated. A position signal is then generated at the onset of the treating operation and the starting position of the machine 10, that position at which the machine 10 has been randomly placed, is identified by triangulation. The machine 10 will compute its position, "read" the position(s) of the area(s) to be treated and will carry out treating operations unattended or with only occasional attendance by a human operator.

The position of the machine 10 at the onset of the treating operation may be identified in yet another way. Normally, an operator periodically attends the operation of such machine. Such operator is equipped with a grid map (arranged in a coordinate system like map 147) of the surface area 33 to be treated. The operator identifies the position of the machine 10 on the grid map 14 and enters the coordinates of that position using the keypad 91. Referring particularly to FIG. 7, the chance of operator error is reduced by predetermining and marking selected positions on the map 145 as indicated by markers S1, S2 and S3. The operator positions the machine 10 at one such marker and enters the appropriate marker identifier information using the keypad 91.

If a surface area 33 such as carpet in an office building is to be treated by vacuuming in accordance with a more complex strategy which recognizes soiling patterns, it will likely be necessary to periodically generate a position signal during the vacuuming operation. Such signal repetitively updates the computing section 65 by sequentially identifying the actual position of the machine 10 during such operation. This permits slight corrective changes to be made in the path being followed by the machine 10.

A method for vacuuming selected surface areas of carpet within a room includes the steps of providing a vacuuming cleaning machine 10 which has a self-propelled chassis 75 and vacuum cleaning apparatus (such as brush 73*a* and nozzle 73*b*) and a computing section 65 mounted on the chassis 75. A powered wheel 79 is mounted on the chassis 75 and has a motor module 67 for receiving command signals from the computing section 65. A position sensor 69 is coupled to the computing section 65 and generates a feedback signal representing the actual position of the machine 10. A data file 71 is coupled to the computing section 65 and is arranged for storing first, second and third sets of digitized data.

The method also includes, in either order, the steps of developing first and second sets of digitized data. In a highly preferred embodiment, the first set of digitized data is developed from a blueprint 29 of the carpet area 33 to be vacuumed. Such data includes coordinates representing main traffic areas 11 and secondary traffic areas 13. The second set of digitized data represents an overall vacuuming cycle and the frequency within such overall cycle at which such main traffic areas 11 and such secondary traffic areas 13 are to be vacuumed.

The method also includes the steps of developing a third set of digitized data and loading the first and second sets of such data into the data file 71. The third set of digitized data represents the day within such overall vacuuming cycle on which vacuuming is then being initiated. After development of such third set of data, it is loaded into the data file 71. Of course, such sets of digitized data are loaded. In a highly preferred regarding routing heuristics and machine parameters stored therein.

Digitized data can be loaded to the data file 7 using any one of several techniques. For example, the machine can be equipped with a disk reader 87*b*. Data is extracted from the CAD computer 27 and loaded to the data file 71 using a floppy disc 87*a*. When the machine is equipped with a tape reader, data can be loaded by tape. A hand-held disc or tape reader 149 may also be used and the data loaded by wire through an input port 151 connected to the data file 71. Yet another way in which the data may be loaded is directly from the CAD computer 27 to the data file via a telephone line and modem. The machine 10 is plugged to a wall port connected to such phone line to facilitate such loading.

The digitized data is processed and a command signal is responsively generated and directed to the motor module 67 for propelling the machine 10 over the surface area selected to be vacuumed. In a highly preferred method, the processing step further includes processing the feedback signal. Since most carpeted areas involve obstructions and/or irregular shapes, position feedback will significantly aid orderly, machine cleaning of such areas.

While the principles of this invention have been described in connection with specific embodiments, it should be understood clearly that these descriptions are made only by way of example and are not intended to limit

What is claimed is:

1. A machine for treating a surface area within a boundary perimeter and including:

a steerable self-propelled chassis having a surface treating device mounted thereon;

a computing section mounted on the chassis;

a plurality of powered wheels mounted on the chassis each having a motor module for receiving command signals from the computing section;

a position sensor coupled to the computing section for generating a feedback signal representing the actual position of the machine;

a data file storing graphic data developed from a graphic depiction representing the surface area to be treated;

a data loading device for transferring graphic data from the data file to the computing section;

the computing section processing the feedback signal and the graphic data and responsively generating command signals directed to the motor modules, thereby propelling the machine for steered travel over the surface area for treatment thereof.

2. The machine of claim 1 wherein the graphic depiction is a blueprint of the surface area and wherein the graphic data is developed usinga cursor and a magnetic pickup board.

3. The machine of claim 1 wherein the graphic depiction is a drawing of the surface area rendered in lines which contrast sharply with the drawing background and wherein the graphic data is developed by scanning such drawing to detect and digitize the locations of such lines.

4. The machine of claim 1 wherein the graphic depiction is developed by imaging the surface area upon a light-sensitive surface.

5. The machine of claim 1 wherein the data loading device includes a machine-readable portable medium insertable into the machine and having the graphic data embedded therein.

6. The machine of claim 6 wherein the graphic data is magnetically embedded in the portable medium.

7. The machine of claim 1 wherein the data loading device includes a modem coupled to the computing section by a telephone line for transferring such graphic data to the machine.

8. A carpet vacuuming machine for treating selected surface areas of carpet and including:

a steerable self-propelled chassis having a carpet vacuuming device mounted thereon;

a computing section mounted on the chassis;

a plurality of powered wheels mounted on the chassis, each such wheel having a motor module for receiving command signals from the computing section and propelling the machine for steered travel to ac ommanded position;

a position sensor coupled to the computing section for generating a feedback signal representing the actual position of the machine;

an error alarm section coupled to the computing section for generating an error signal when the commanded position of the machine and the actual position of the machine differ;

a keypad coupled to the computing section for permitting the manual entry of data into such computing section;

a data file storing graphic data developed from a graphic depiction representing the carpeted area;

a data loading device for transferring graphic data from the data file to the computing section;

the computing section being arranged for processing the feedback signal and the graphic data transmitted to the computing section and responsively generating command signals directed to the motor modules, thereby propelling the machine for steered travel areas and vacuum cleaning such areas.

9. The machine of claim 8 wherein the starting point is pre-identified and is consistently the same starting point for the particular surface area to be treated.

10. The machine of claim 8 wherein the carpeted area has a wall along at least one boundary thereof, wherein such wall has a passive device mounted thereon with information encoded therein, wherein the position sensor has a scanning capability and wherein the starting point is identified when the position sensor scans such information-encoded device.

11. The machine of claim 8 wherein the carpeted area is within a room, wherein such room has at least two active devices mounted therein, wherein each such active device emits signals representing encoded information and wherein the starting point is identified when the position sensor detects signals emitted from each of such active devices.

12. A method for using a carpet vacuuming machine having carpet vacuuming means, a computing section and machine-propelling motor modules to vacuum selected surface areas of carpet within a room and including, in either order, the steps of:

developing a first set of digitized data from a graphic depiction of the carpet area to be vacuumed, such data including coordinates representing main traffic areas and secondary traffic areas;

developing a second set of digitized data which represents an overall vacuuming cycle and the cleaning regimen within such cycle by which both such traffic areas are to be vacuumed;

and further including the steps of:

loading the first and the second sets of digitized data into the computing section;

developing a third set of digitized data which represents the day within such overall vacuuming cycle on which vacuuming is then being initiated and loading such third set of digitized dat into the computing section;

processing the first, second and third sets of digitized data and responsively generating command signals directed to the motor modules, thereby propelling the machine over selected traffic areas and vacuum cleaning such areas in accordance with the cleaning regimen.

13. The method of claim 12 wherein the step of developing a third set of digitized data includes the steps of:

developing digitized data which represnts the day within such overall vacuuming cycle on which vacuuming is then being initiated;

selecting an intensity at which selected surface areas of carpet are to be vacuumed; and, loading such third set of digitized data into the computing section.

14. The method of claim 12 wherein the processing step further includes processing the feedback signal.

15. The method of claim 12 wherein the machine includes a keypad and the third set of digitized data is developed by entering a date on a keypad.

16. The method of claim 12 wherein the data file has routing heuristics and machine parameters stored therein.

17. The method of claim 16 wherein the first set of digitized data is developed from a blueprint of the carpeted area to be vacuumed.

18. A robotic carpet cleaning machine havbing computerized control means, embedded programs and data for guiding said machine over a carpeted area to be cleaned, the improvement wherein such data includes graphic data developed from a pictorial representation of the area.

19. The improvement of claim 18 wherein the pictorial representation includes main and secondary traffic areas.

20. The improvement of claim 19 wherein the machine cleans carpet by vacuuming and the data includes data representing an overall vacuuming cycle and a cleaning regiment within such voerall cycle by which such main and secondary traffic areas are to be vacuumed.

21. The improvement of claim 18 wherein the pictorial representation is a blueprint of the area and the graphic data is developed using a cursor and magnetic pickup board.

22. In a method for using a self-propelled robotic machine for vacuuming an area of carpet and including the steps of developing a computer program controlling the travel movements of such machine, the improvement in the method comprising, in either order, the steps of:

developing a first set of digitized data from a graphic depiction of the carpet area;

developing a second set of digitized data representing an overall vacuuming cycle and a cleaning regiment within such overall cycle;

and further including the steps of:

processing the first and second sets of digitized data; and, responsively generating command signals directed to motor modules to propel the machine over the area, thereby cleaning carpet.

23. The method of claim 22 wherein the first set of digitized data includes coordinates representing main traffic areas and secondary traffic areas.

24. The method of claim 23 wherein such main and secondary traffic areas are vacuumed in accordance with the cleaning regiment.

* * * * *

UNITED STATES PATENT AND TRADEMARK OFFICE
CERTIFICATE OF CORRECTION

PATENT NO. : 5,086,535

DATED : February 11, 1992

INVENTOR(S) : Mark Grossmeyer and Geoffrey B. Rench

It is certified that error appears in the above-identified patent and that said Letters Patent is hereby corrected as shown below: Title page, Under OTHER PUBLICATIONS, "Host Camp Carpet Maintenance Paln" should be --Host Camp Carpet Maintenance Plan--.

In column 1, line 57, after "frequencies", insert --.--.

In column 2, line 17, after "signals", insert --.--.

In column 2, line 32, after "time", insert --.--.

In column 3, line 36, after "function", insert --.--.

In column 3, line 46, after "like", insert --.--.

In column 3, line 67, after "frequency", insert --.--.

In column 4, line 13, after the second occurrence of "section", insert --.--.

In column 4, line 25, after "treated", insert --.--.

In column 4, line 36, after "keypad", insert --.--.

In column 4, line 39, after "differ", insert --.--.

In column 4, line 53, after "perimeter", insert --.--.

In column 4, line 64, after "drawing", insert --.--.

In column 5, line 16, after "thereon", insert --.--.

In column 5, line 18, the paragraph commencing with "the locations" should not be a new paragraph, but rather a continuation of the second full paragraph of column 5.

UNITED STATES PATENT AND TRADEMARK OFFICE

CERTIFICATE OF CORRECTION

PATENT NO. : 5,086,535

DATED : February 11, 1992

INVENTOR(S) : Mark Grossmeyer and Geoffrey B. Rench

It is certified that error appears in the above-identified patent and that said Letters Patent is hereby corrected as shown below:

In column 5, line 68, after the first occurrence of "regimen", insert --.--.

In column 6, line 30, after "cycle", insert --.--.

In column 6, line 37, after "vacuumed", insert --.--.

In column 9, line 58 should be aligned with the left margin rather than indented.

In column 9, line 67, delete "3!" and insert --31--.

In column 9, line 68, delete "5I" and insert --51--.

In column 10, line 36, after "treatment", insert --.--.

In column 11, line 10, after the words "traffic areas", insert --11, 13.--.

In column 11, line 11, the paragraph commencing with "Such data" should not be a new paragraph, but rather a continuation of the first paragraph of column 11.

In column 11, line 31, after "65", insert --.--.

In column 11, line 47, after "operator", insert --.--.

In column 12, line 35, delete "1n" and insert --In--.

In column 14, line 2, delete "vacuume.d" and insert --vacuumed--.

UNITED STATES PATENT AND TRADEMARK OFFICE
CERTIFICATE OF CORRECTION

PATENT NO. : 5,086,535

DATED : February 11, 1992

INVENTOR(S) : Mark Grossmeyer and Geoffrey B. Rench

It is certified that error appears in the above-identified patent and that said Letters Patent is hereby corrected as shown below:

In column 15, line 26, delete "116" and insert --115--.

In column 15, line 64, delete "11b" and insert --11b--.

In column 17, line 59, delete "7" and insert --71--.

In column 17, line 55, after "such", insert --loading may occur before or after the first and second--.

In column 17, line 56, after "preferred", insert --embodiment, the data file 71 also has information--.

In column 18, line 17, after "limit", insert --the scope of the invention.--.

In claim 2, line 43, delete "usinga" and insert --using a--.

Col. 19

In claim 8, line 5, delete "ac ommanded" and insert --a commanded--.

In claim 12, line 62, delete "dat" and insert --data--.

Col. 20,

In claim 13, line 6, delete "represnts" and insert --represents--.

In claim 18, line 24, delete "A" and insert --In a--.

In claim 18, line 24, delete "havbing" and insert --having--.

In claim 20, line 36, delete "regiment" and insert --regimen--.

UNITED STATES PATENT AND TRADEMARK OFFICE

CERTIFICATE OF CORRECTION

PATENT NO. : 5,086,535

DATED : February 11, 1992

INVENTOR(S) : Mark Grossmeyer and Geoffrey B. Rench

It is certified that error appears in the above-identified patent and that said Letters Patent is hereby corrected as shown below:

In claim 20, line 36, delete "voerall" and insert --overall--.

In claim 22, line 52 and 53, delete "regi-ment" and insert --regimen--.

In claim 22, line 54 should be aligned with the left margin rather than indented.

In claim 24, line 65, delete "regiment" and insert --regimen--.

Signed and Sealed this

First Day of June, 1993

*Attest:*

Michael K. Kirk

MICHAEL K. KIRK

*Attesting Officer*

*Acting Commissioner of Patents and Trademarks*